US007365480B2

(12) United States Patent
Honda et al.

(10) Patent No.: US 7,365,480 B2
(45) Date of Patent: Apr. 29, 2008

(54) SPARK PLUG

(75) Inventors: Toshitaka Honda, Iwakura (JP); Tsutomu Shibata, Owariasahi (JP)

(73) Assignee: NGK Spark Plug Co., Ltd., Aichi (JP)

( * ) Notice: Subject to any disclaimer, the term of this patent is extended or adjusted under 35 U.S.C. 154(b) by 577 days.

(21) Appl. No.: 11/114,074

(22) Filed: Apr. 26, 2005

(65) Prior Publication Data

US 2005/0242694 A1 Nov. 3, 2005

(30) Foreign Application Priority Data

Apr. 30, 2004 (JP) ..... P. 2004-136186

(51) Int. Cl.
*H01T 13/20* (2006.01)

(52) U.S. Cl. ..... 313/143; 313/118; 313/141

(58) Field of Classification Search ..... 313/118, 313/136, 137, 141, 143
See application file for complete search history.

(56) References Cited

U.S. PATENT DOCUMENTS

| | | | | |
|---|---|---|---|---|
| 5,565,730 | A | 10/1996 | Pollner et al. | |
| 6,137,211 | A | 10/2000 | Sugimoto et al. | |
| 6,744,189 | B2 | 6/2004 | Honda | |
| 2002/0024160 | A1* | 2/2002 | Sugimoto | 264/12 |
| 2003/0127959 | A1* | 7/2003 | Nishikawa et al. | 313/143 |

FOREIGN PATENT DOCUMENTS

| | | | |
|---|---|---|---|
| DE | 43 06 402 | A1 | 9/1994 |
| EP | 1 274 157 | A1 | 1/2003 |
| JP | 2003-22886 | | 1/2003 |
| WO | WO 01/74728 | A1 | 10/2001 |
| WO | WO 01/74731 | A1 | 10/2001 |

* cited by examiner

*Primary Examiner*—Toan Ton
*Assistant Examiner*—Kevin Quarterman
(74) *Attorney, Agent, or Firm*—Sughrue Mion, PLLC

(57) ABSTRACT

A spark plug including: a external terminal; a center electrode; an insulator having a through hole as defined herein and containing alumina ceramics; and a conductive seal. The conductive seal contains base glass, a conductive filler and from 0 to 10 weight % of an insulating filler, and the base glass contains Si, B, Ca, Al, Na and K components in amounts defined herein. Also disclosed is a spark plug including a center electrode; an external terminal; a first conductive seal; a second conductive seal; a resistor provided as defined herein; and an insulator having a through hole as defined herein. The center electrode and the external terminal are bonded to the first conductive seal and the second conductive seal, respectively, in the through hole. The first and second conductive seals each contains base glass, a conductive filler and amounts of an insulating filler as defined herein.

10 Claims, 8 Drawing Sheets

SPARK PLUG

BACKGROUND OF THE INVENTION

1. Field of the Invention

The present invention relates to a spark plug for use in an internal combustion engine.

BACKGROUND OF THE INVENTION

2. Description of the Related Art

Widely used conventional spark plugs include an insulator having a through hole in an axial direction of the spark plug and which comprises alumina ceramics, a center electrode partially inserted in a front end of the through hole, an external terminal partially inserted in a rear end of the through hole, and a conductive seal provided between the external terminal and the center electrode in the through hole.

In such a spark plug, it is known (in reference to JP-A-2003-22886 corresponding to U.S. Pat. No. 6,744,189, for example) that compression stress on the conductive seal prevents cracking and peeling at the interface between the conductive seal and the insulator. To achieve this effect, the conductive seal is proposed to contain an inorganic material having a thermal expansion coefficient lower than that of alumina constituting the insulator, such as an insulating filler composed of β-eucriptite, β-spodumene, keatite, silica, mullite, cordierite, zircon and aluminum titanate, so that the conductive seal assumes a smaller thermal expansion coefficient than that of the insulator.

3. Problems to be Solved by the Invention

However, the conductive seal containing the insulating filler as described above results in an increased amount of solid components at the time when the base glass in the conductive seal is softened, and thereby causes increased hardness of the conductive seal as a whole. While press-fitting an external terminal against the conductive seal, the conductive seal is heated so as to soften the base glass, and then cooled so as to seal and fix the external terminal and the center electrode with the conductive seal (hereinafter also called a "glass sealing process"). In this process, the aforementioned conductive seal can be too hard to apply a sufficient sealing load to the external terminal, thus causing so-called "terminal misalignment", in which the external terminal is not sufficiently inserted into the insulator. If the sealing load is simply increased, on the other hand, the insulator may break when the external terminal is press-fitted in the insulator.

SUMMARY OF THE INVENTION

The present invention has been conceived to solve the above-described problems. It is therefore an object of the present invention to provide a spark plug having excellent productivity and reliability and which is able to prevent the conductive seal from cracking or peeling, the terminal after glass-sealing from misaligning, and the insulator or the like from breaking during the glass sealing process. More particularly, an object of the invention is to achieve the above noted effects by adjusting the linear expansion coefficient of the conductive seal so as to be less than that of the insulator, while also reducing the hardness of the conductive seal.

According to a first aspect, the invention provides a spark plug which comprises a conductive seal arranged between an external terminal and a center electrode in a through hole formed axially in an insulator made of alumina ceramics, wherein the conductive seal contains base glass, a conductive filler, and an insulating filler in an amount of 10 weight % or less (including 0 weight %), wherein the base glass contains a Si component in an amount of from 55 to 65 weight %, as converted to $SiO_2$ (in terms of $SiO_2$), a B component in an amount of from 22 to 35 weight %, as converted to $B_2O_3$, a Ca component in an amount of from 0.2 to 2 weight %, as converted to CaO, an Al component in an amount of 2 weight % or less, as converted to $Al_2O_3$, and a Na component and a K component in a total amount of from 4 to 8 weight %, as converted to $Na_2O$ and $K_2O$, respectively, and wherein the base glass contains both the Na component and the K component.

In the invention, the content of the insulating filler in the conductive seal is adjusted to 10 weight % or less. This makes it possible to reduce the hardness of the entire conductive seal when the base glass is softened. Therefore, even if the sealing load during the glass sealing process is relatively small, it is possible to prevent terminal misalignment and insulator breakage. This effect cannot be sufficiently attained if the content of the insulating filler in the conductive seal exceeds 10 weight %.

In the invention, moreover, due to the above composition of the base glass constituting the conductive seal, the resultant thermal expansion coefficient of the conductive seal can be set so as to be smaller than that of the insulator made of alumina ceramics without including too much insulating filler in the conductive seal. As a result, compression stress can be imparted to the conductive seal, without causing cracks or exfoliation.

Specifically, the base glass composing the conductive seal contains a Si component in an amount of from 55 to 65 weight %, as converted to $SiO_2$, a B component in an amount of from 22 to 35 weight %, as converted to $B_2O_3$, a Ca component in an amount of from 0.2 to 2 weight %, as converted to CaO, an Al component in an amount of from 2 weight % or less, as converted into $Al_2O_3$, and a Na component and a K component in a total amount of from 4 to 8 weight %, as converted to $Na_2O$ and $K_2O$, respectively, and the base glass contains both the Na component and the K component.

The individual components of the base glass are described below.

When the weight of the Si component, as converted to the $SiO_2$, is less than 55 weight %, the thermal expansion coefficient of the base glass may become so large as to cause peeling or cracks between the conductive seal and the insulator. If the converted weight exceeds 65 weight %, on the other hand, the softening temperature of the base glass may become so high as to cause terminal misalignment during the glass sealing process.

When the weight of the B component, as converted to $B_2O_3$, is less than 22 weight %, the softening temperature of the base glass may become so high as to cause terminal misalignment during the glass sealing process. When the converted weight exceeds 35 weight %, on the other hand, the thermal expansion coefficient of the base glass may become so large as to cause peeling or cracks between the conductive seal and the insulator.

On the other hand, the Ca component is added to stabilize the resistor in contact with the conductive seal containing the base glass or to lower the softening temperature of the base glass itself. If the weight of the Ca component, as converted to CaO, is less than 0.2 weight %, the resistance of the resistor may not be adequately stabilized, or the softening temperature of the base glass may not be sufficiently lowered so as to cause terminal misalignment during the glass sealing process. If the converted weight exceeds 2 weight %, the thermal expansion coefficient may become so large as to cause peeling or exfoliation between the conductive seal and the insulator.

The Al component is contained in the base glass as an inevitable impurity. If the weight of the Al component, as converted to $Al_2O_3$, is more than 2 weight %, the softening temperature of the base glass may become so high as to cause terminal misalignment during the glass sealing process. Preferably, the content of the Al component is closer to 0 weight %.

Both the Na component and the K component are added to lower the softening temperature of the base glass. Since both the Na component and the K component are contained in the base glass, a resultant alkali synergistic effect effectively lowers the softening temperature of the base glass.

If the total of the contents of the Na component, as converted to $Na_2O$, and the K component, as converted to $K_2O$, is less than 4 weight %, it may become difficult to lower the softening temperature of the base glass, to thereby cause terminal misalignment during the glass sealing process. To the contrary, if the total amount of the two contents exceeds 8 weight %, the thermal expansion coefficients of the seal may become so large as to cause peeling or cracking between the conductive seal and the insulator.

In the spark plug of the invention, moreover, the relationship $W1 \geqq W2$ is preferably satisfied, where the weight of the Na component in the base glass, as converted to $Na_2O$, is given by W1 and where the weight of the K component, as converted to $K_2O$, is given by W2. When the Na component and the K component are used, an increased amount of the Na component tends to reduce the thermal expansion coefficient of the base glass. By setting the aforementioned relationship to $W1 \geqq W2$, the thermal expansion coefficient can be reduced while lowering the softening temperature of the base glass.

More preferably, the relationship $W1 \geqq W2 \geqq W1/5$ is satisfied. Although from the aforementioned viewpoint of thermal expansion coefficient the content of the Na component is preferably greater than that of the K component, a sufficient amount of the K component relative to the Na component is required to sufficiently lower the softening temperature of the base glass.

According to the invention, the base glass contains as essential components, a Si component, a B component, a Ca component, a Na component and a K component. However, the base glass may contain other components such as a Zr component, a Ti component and a MgO component, if necessary and within a range such that the desired effect is achieved. In this modification, the total content of other components, as converted to their respective oxides, is preferably 10 weight % or less for the entire base glass.

In the spark plug of the invention, moreover, the conductive seal is preferably made of the base glass and the conductive filler without including any insulating filler. Thus, the hardness of the conductive seal can be further reduced during the glass sealing process. As a result, terminal misalignment can be more effectively prevented during the glass sealing process.

In the spark plug of the invention, moreover, the total of the weight of the Si component in the base glass, as converted to $SiO_2$, and the weight of the B component, as converted to $B_2O_3$, is preferably from 86 to 94 weight %. Therefore, it is possible to adequately reduce the thermal expansion coefficient of the conductive seal.

According to a second aspect, the invention provides a spark plug comprising: a center electrode and an external terminal fixed on a first conductive seal and a second conductive seal, respectively, in a through hole formed axially in an insulator; and a resistor interposed between the first conductive seal and the conductive seal, wherein the second conductive seal contains base glass, a conductive filler, and 10 weight % or less, but more than 0 weight % of an insulating filler, and wherein the first conductive seal contains base glass, a conductive filler, and an insulating filler in an amount (including 0 weight %) smaller than that of the insulating filler contained in the second conductive seal.

In the invention, the content of insulating filler in each of the first conductive seal and the second conductive seals is adjusted to 10 weight % or less. This makes it possible to reduce the hardness of the conductive seals when the base glass of the first and second conductive seals is softened. Therefore, even if the sealing load during the glass sealing process is relatively small, it is possible to prevent the terminal from becoming misaligned. Moreover, the reduced sealing load can prevent the insulator from breaking during the glass sealing process. These effects cannot be sufficiently attained if the content of the insulating filler in the first conductive seal or the second conductive seal exceeds 10 weight %.

Moreover, since the content of insulating filler in the second conductive seal is more than the content of insulating filler in the first conductive seal, the hardness of the second conductive seal during the glass sealing process is higher than that of the first conductive seal during the glass sealing process. Consequently, the resistor interposed between the first conductive seal and the second conductive seal can be sufficiently filled and fixed inside by pushing the second conductive seal. Such effect can be sufficiently secured by setting the content of the insulating filler in the second conductive seal to 1 weight % or more than that of the insulating filler in the first conductive seal.

Non-limiting examples of the insulating filler for use in the present invention include β-eucriptite, β-spodumene, keatite, silica, mullite, cordierite, zircon, aluminum titanate, titanium dioxide and insulating ceramic fillers in general, but excluding components of the base glass.

DETAILED DESCRIPTION OF THE INVENTION

The invention is next described in detail by reference to the drawings. However, the present invention should not be construed as being limited thereto.

A first embodiment is described as follows.

Figure 1:
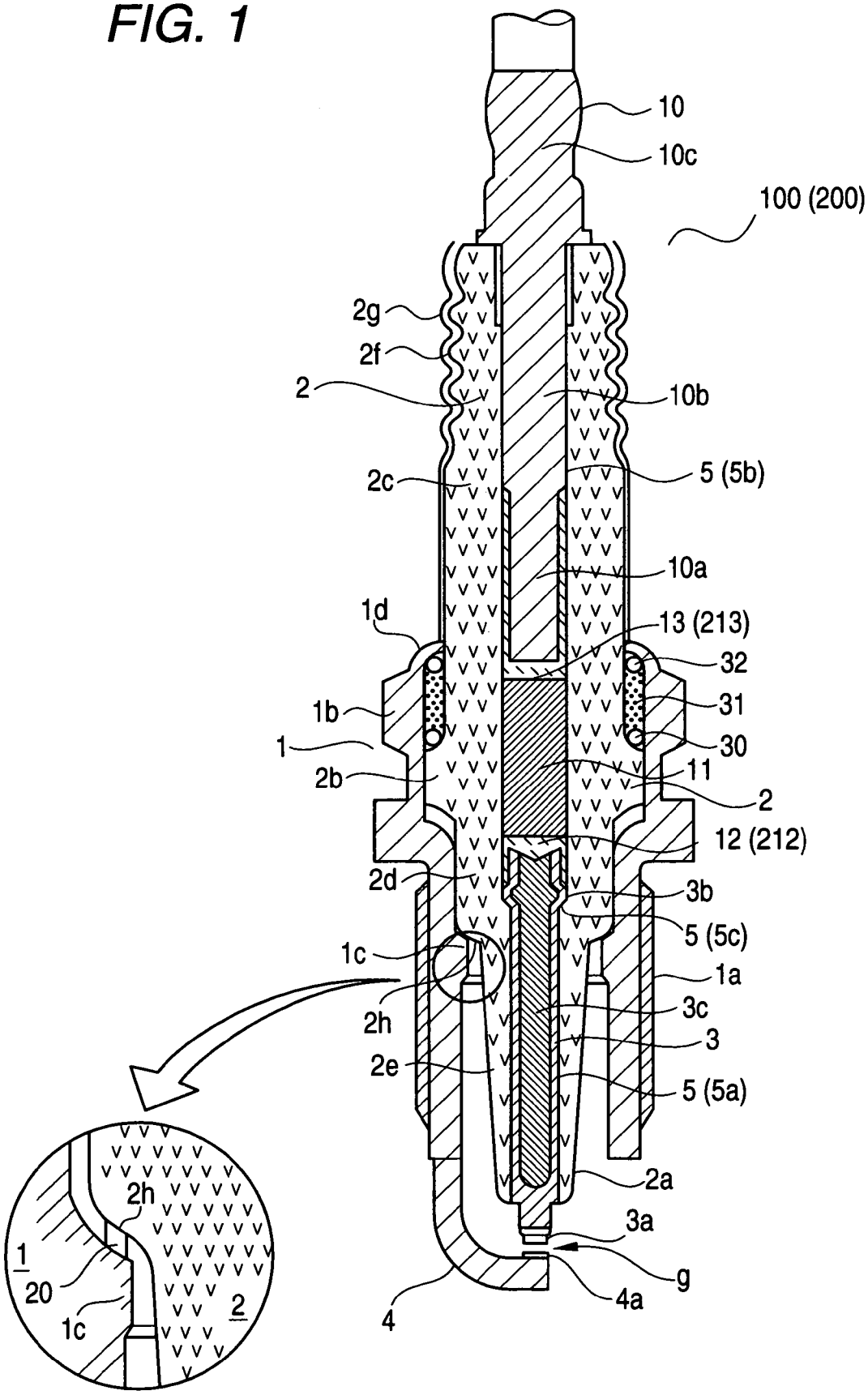
FIG. 1 is a sectional view showing an embodiment of a spark plug of the invention.

FIG. 1 shows one example of a spark plug 100 according to the first embodiment. The spark plug 100 includes: a cylindrical metal shell 1; an insulator 2 fitted in the metal shell 1 and having a though hole 5 in an axial (longitudinal) direction of the spark plug 100 and a front end portion 2*a* protruding therefrom; a center electrode 3 disposed in a front portion of the through hole 5 and having an ignition tip 3*a* on its front end protruding from the through hole 5; and a ground electrode 4 having an end joined to the metal shell 1 by a welding method or the like and a leading end bent to face the front end of the center electrode 3. The ground electrode 4 is provided with an ignition tip 4*a* aligned with the ignition tip 3*a* to thereby provide a spark discharge gap g therebetween.

The metal shell 1 is made of a metal such as a low-carbon steel and includes a cylindrical shape having a threaded portion 1*a* for mounting the spark plug 100 on its outer circumference and a hexagonal tool-engaging portion 1*b* for engaging with a tool such as a spanner or wrench when the metal shell 1 is mounted in an engine block.

The insulator 2 is entirely made of alumina ceramics containing an Al component in an amount of 80 to 98 mol % (preferably 90 to 98 mol %), as converted to $Al_2O_3$.

Specifically, the alumina ceramics can, for example, contain components other than Al of one kind or two or more kinds in the following ranges:

Si Component: 1.50 to 5.00 mol %, as converted to $SiO_2$ (in terms of $SiO_2$);

Ca Component: 1.20 to 4.00 mol %, as converted to CaO;

Mg Component: 0.05 to 0.17 mol %, as converted to MgO;

Ba Component: 0.15 to 0.50 mol %, as converted to BaO; and

B Component: 0.15 to 0.50 mol %, as converted to $B_2O_3$.

A bulge 2*b* projecting outwardly in a radial direction in a flange shape is provided in the middle of the insulator 2. An insulator body 2*c* formed on the rear end side of the insulator 2 is thinner than the bulge 2*b*. At the rear end portion of the outer circumference of the insulator body 2*c*, a corrugated portion 2*f* is formed on which a glaze layer 2*g* is formed.

On the front end side of the bulge 2*b*, on the other hand, a first shank 2*d* having a smaller diameter than that of the bulge 2*b* and a second shank 2*e* having a smaller diameter than that of the first shank 2*d*, are sequentially formed in the recited order. The first shank 2*d* has a substantially cylindrical outer circumference, and the second shank 2*e* has a substantially conical shape, in which an outer circumference is tapered toward the front end.

The through hole 5 of the insulator 2 is composed of a first portion 5*a* of a substantially cylindrical shape for inserting the center electrode 3 therethrough, and a second portion 5*b* formed on the rear end side of the first portion 5*a* and having a substantially cylindrical shape of a larger diameter than that of the first portion 5*a*. An external terminal 10 and a resistor 11 are provided in the second (rear) portion 5*b*, and the center electrode 3 is inserted into the first (front) portion 5*a*.

An electrode fixing bulge 3*b* is formed to bulge from the outer circumference of the rear end portion of the center electrode 3. Moreover, the first portion 5*a* and the second portion 5*b* of the through hole 5 are connected to each other in the first shank 2*d*. At this connected position, a bulge receiving face 5*c* for receiving the electrode fixing bulge 3*b* of the center electrode 3 is formed to have a tapered face or a rounded face.

On the other hand, a connecting portion 2*h* on the outer circumferences of the first shank 2*d* and the second shank 2*e* is stepped to engage through a ring-shaped plate packing 20 with a ridge 1*c*, which is formed on the inner face of the metal shell 1 to act as an engagement portion of the metal shell 1, to thereby prevent axial looseness.

On the other hand, a ring-shaped wire packing 30 engaged with the rear side of the flange-shaped bulge 2*b*, a ring-shaped wire packing 32, and a filler layer 31 of talc or the like provided therebetween are arranged between the rear end side of the metal shell 1 and the outer face of the insulator 2. The insulator 2 is fastened and fixed in a axial direction between the ridge 1*c* of the metal shell 1 and a fastened portion 1*d* of the metal shell 1.

The resistor 11 is arranged in the through hole 5 between the external terminal 10 and the center electrode 3. This resistor 11 is electrically connected at its two end portions with the center electrode 3 and the external terminal 10 respectively, through a first conductive seal 12 and a second conductive seal 13.

The resistor 11 is made of a resistor composite, which is prepared by heat-pressing a mixture of glass powder and conductor powder (and ceramic powder other than glass, if needed) during a later-described glass sealing process. Here, the resistor 11 may be omitted to bond the external terminal 10 and the center electrode 3 by a single conductive seal.

The external terminal 10 is made of low-carbon steel or the like and has a Ni-plated layer (having a thickness of 5 μm, for example) formed on its surface for corrosion protection. The external terminal 10 includes: a sealing portion 10*a* (or a front end portion); a connecting portion 10*c*protruding from the rear end edge of the insulator 2; and a rod-shaped portion 10*b* provided between the connecting portion 10*c* and the sealing portion 10*a*.

The sealing portion 10*a* is formed in an axially long cylindrical shape having a threaded or ribbed ridge on its outer circumference. The sealing portion 10*a* is embedded in the conductive seal 13 so that the conductive seal 13 seals the gap between the sealing portion 10*a* and the inner face of the through hole 5.

The bodies of the ground electrode 4 and the center electrode 3 are made of a Ni alloy, a Fe alloy or the like. Moreover, a core 3*c* is buried in the body of the center electrode 3, which core is made of Cu or a Cu alloy for promoting heat transfer. A core may also be buried in the ground electrode 4. On the other hand, the ignition tip 3*a* and the ignition tip 4*a* are made mainly of a precious metal alloy composed mainly of one or more kinds of Ir, Pt and Rh. It is also possible to omit one or both of the ignition tip 3*a* and the ignition tip 4*a*.

The first conductive seal 12 and the second conductive seal form an important part of the spark plug 100 of the first embodiment, and are made of base glass and conductive filler.

The conductive filler contained in the conductive seals 12 and 13 is exemplified by metal powder composed mainly of one or more kinds of metal components such as Cu and Fe or alloys thereof Thus, the content of insulating filler in the first conductive seal 12 and the second conductive seal 13 is set to 10 weight % or less. As a result, it is possible to reduce the hardness of the first conductive seal 12 and the second conductive seal 13 during a glass sealing process in which the base glass is softened. Therefore, it is possible to prevent terminal misalignment during the glass sealing process. Moreover, the sealing load need not be increased, so as to prevent the insulator 2 from breaking during the glass sealing process.

Moreover, the base glass in the first conductive seal 12 and the second conductive seal 13 contains a Si component in an amount of from 55 to 65 weight %, as converted to $SiO_2$, a B component in an amount of from 22 to 35 weight %, as converted to $B_2O_3$, a Ca component in an amount of from 0.2 to 2 weight %, as converted to CaO, an Al component in an amount of 2 weight % or less, as converted to $Al_2O_3$, and a Na component and a K component in a total amount of from 4 to 8 weight %, as converted to $Na_2O$ and $K_2O$, respectively. The base glass contains both the Na component and the K component.

The base glass in the first conductive seal 12 and the second conductive seal 13 is formulated to have the aforementioned composition. As a result, the coefficient of thermal expansion of the first conductive seal 12 and the second conductive seal 13 containing the base glass is set so as to be less than that of the insulator 2, thereby preventing the spread of cracks, exfoliation and the like in the first conductive seal 12 and the second conductive seal 13.

One example of a process for manufacturing the spark plug 100 of Embodiment 1 is described as follows. First of all, for the insulator 2, a molding base slurry is prepared by blending an alumina powder as a material powder with individual component source powders containing the Si component, the Ca component, the Mg component, the Ba component and the B component at such predetermined ratios as will make the aforementioned composition, as converted to their respective oxides, after a sintering process thereof, and by adding and mixing predetermined amounts of a binder (e.g., PVA) and water. Here, the individual component source powders can be blended, for example, in the form of $SiO_2$powder as the Si component, $CaCO_3$ powder as the Ca component, MgO powder as the Mg component, $BaCO_3$ powder as the Ba component, and $H_3BO_3$ powder as the B component. Moreover, the $H_3BO_3$ may also be blended in the form of a solution.

The molding base slurry is sprayed and dried into molding base granules by a spray drying method or the like. Then, the molding base granules are molded by a rubber press into a compact for a prototype of the insulator. Then, the compact is sintered in the atmosphere at 1,400 to 1,600° C. for 1 to 8 hours to thereby prepare the insulator 2.

On the other hand, the conductive sealer powder is prepared in the following manner. Specifically, the base glass powder containing the aforementioned individual components at the predetermined compositions and the conductive filler powder are blended at a predetermined composition to make a blended material. A mixing pot is charged with the blended material together with an aqueous solvent and a mixing media (e.g., ceramics such as alumina), and is turned to mix and disperse the aforementioned materials homogeneously.

Next, the center electrode 3 and external terminal 10 are assembled with the insulator 2, and the resistor 11 and the conductive seals 12 and 13 are formed by a glass sealing process, as described below.

Figure 2:
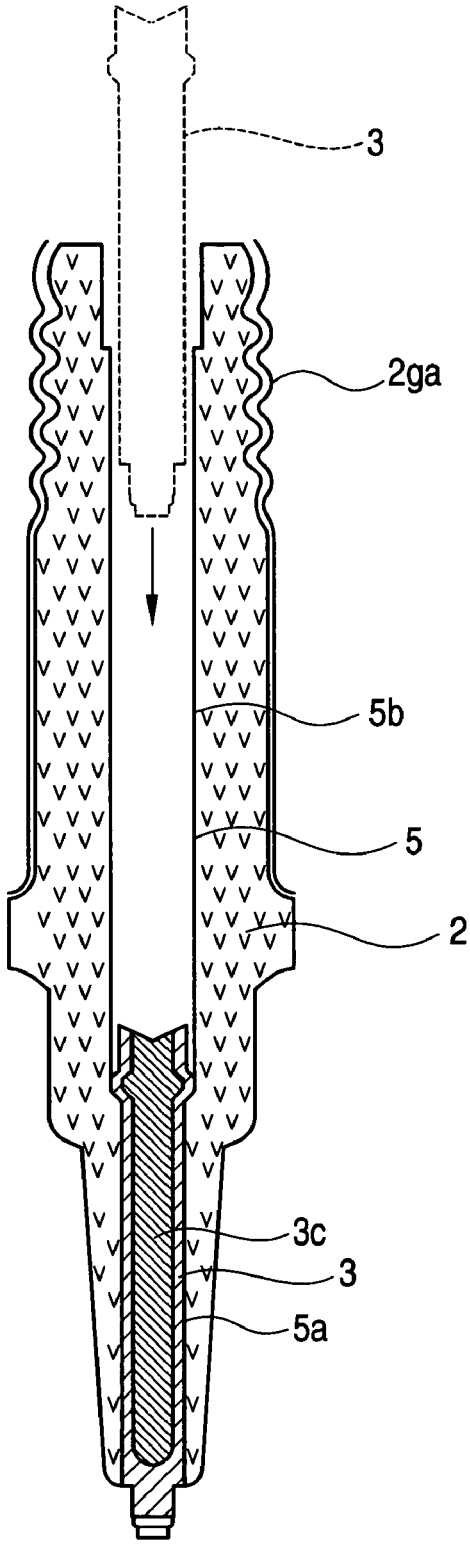
FIG. 2 is a sectional view showing an example of a spark plug manufacturing process of the invention.
Figure 3:
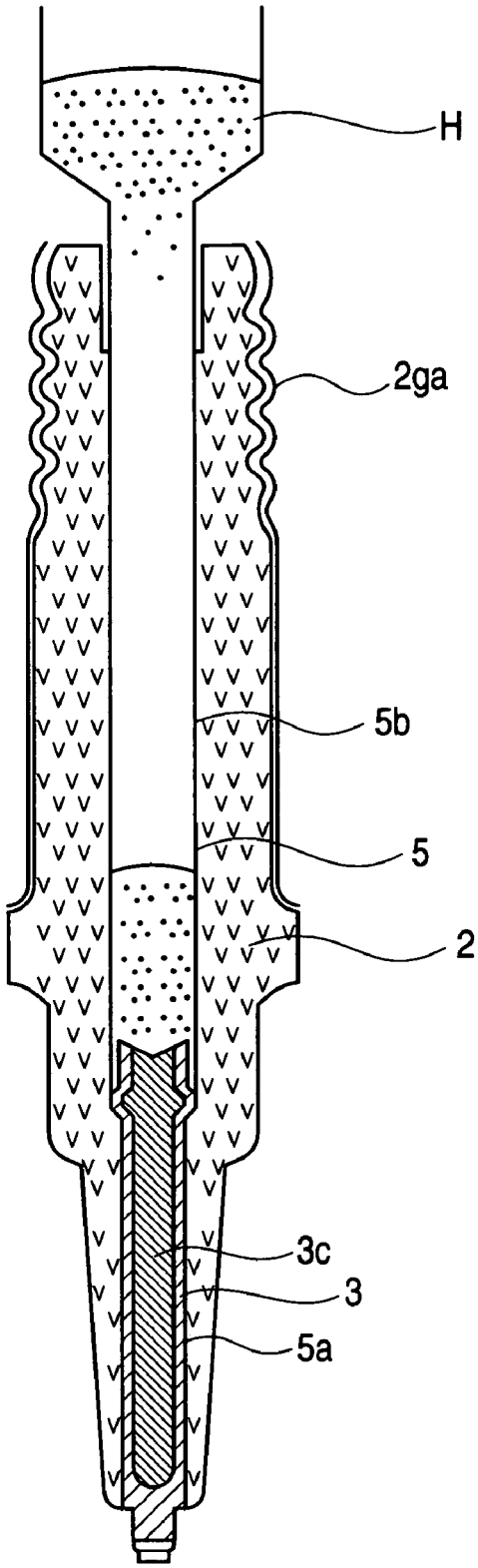
FIG. 3 is a sectional view showing an example of the spark plug manufacturing process of the invention.
Figure 4:
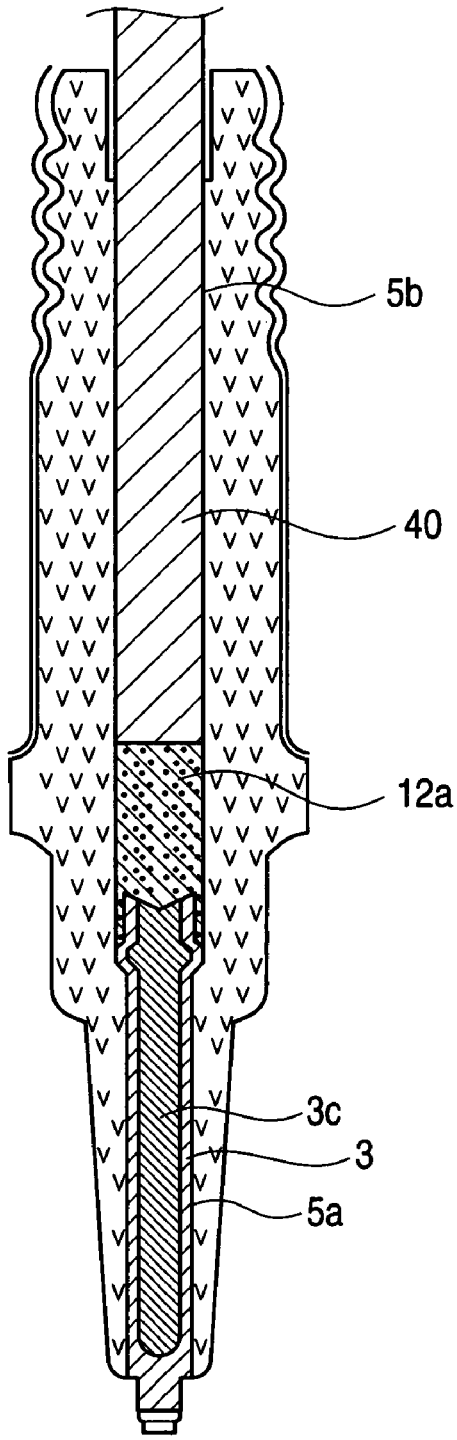
FIG. 4 is a sectional view showing an example of the spark plug manufacturing process of the invention.

At first, the glaze slurry is sprayed and applied from a spray nozzle to a predetermined surface of the insulator 2 to thereby form a glaze-slurry layer 2*ga* (FIG. 2) which is to become the glaze this glaze-slurry layer 2*ga* is dried. Next, the center electrode 3 is inserted into the first portion 5*a* of the through hole 5 of the insulator 2, which has the glaze-slurry layer 2*ga*, as shown in FIG. 2, and conductive sealer powder H is charged into the through hole 5, as shown in FIG. 3. Then, the filled powder H is preliminarily compressed by a presser bar 40 in the through hole 5, as shown in FIG. 4, to thereby form a first conductive sealer powder layer 12*a*.

Figure 5:
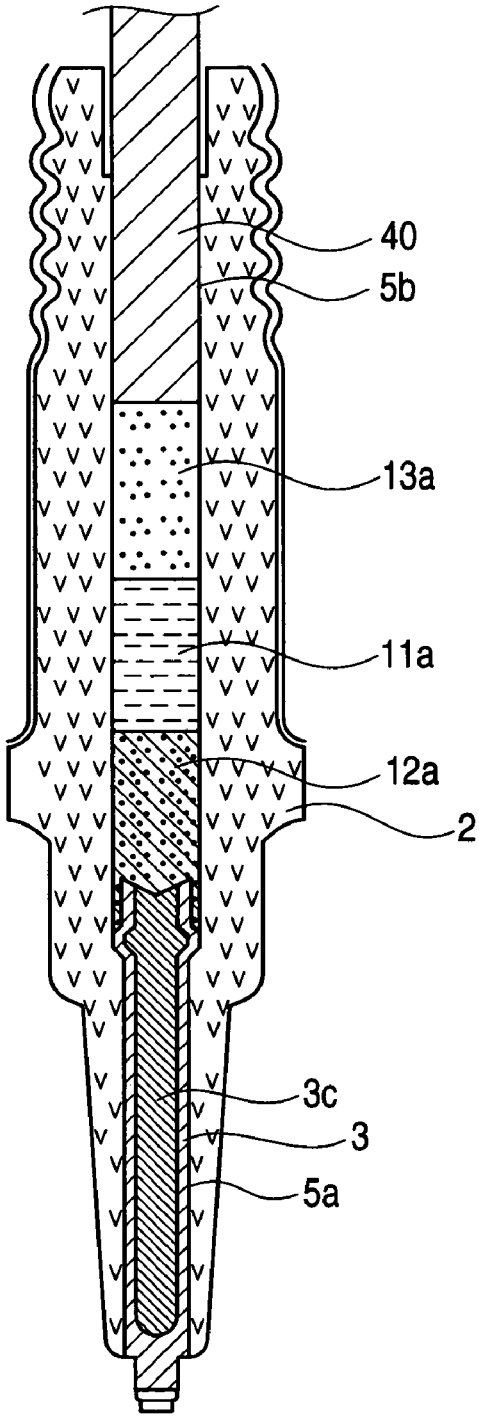
FIG. 5 is a sectional view showing an example of the spark plug manufacturing process of the invention.

Next, the material powder of the resistor composite is charged into the through hole 5 on the first conductive sealer powder layer 12*a*, and is likewise preliminarily compressed to form a resistor powder layer 11*a*. Then, the conductive sealer powder H is also charged on the resistor composite powder layer 11*a*, and is preliminarily compressed by the presser bar 40 to form a second conductive sealer powder layer 13*a*. As a result, the first conductive sealer powder layer 12*a*, the resistor composite powder layer 11*a* and the second conductive sealer powder layer 13*a* are stacked in the through hole 5 as viewed from the side of the center electrode 3, as shown in FIG. 5.

Figure 6:
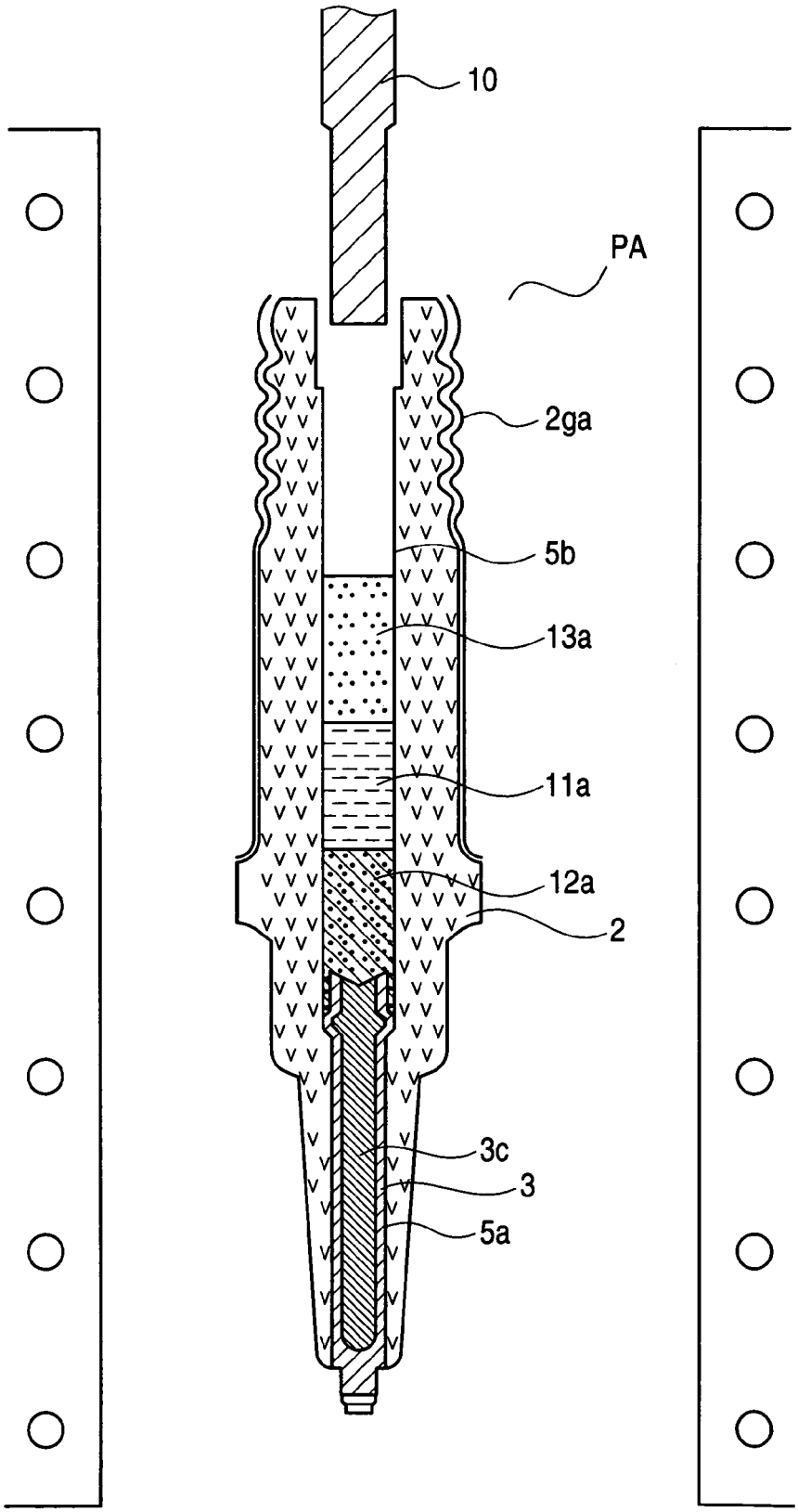
FIG. 6 is a sectional view showing an example of the spark plug manufacturing process of the invention.
Figure 7:
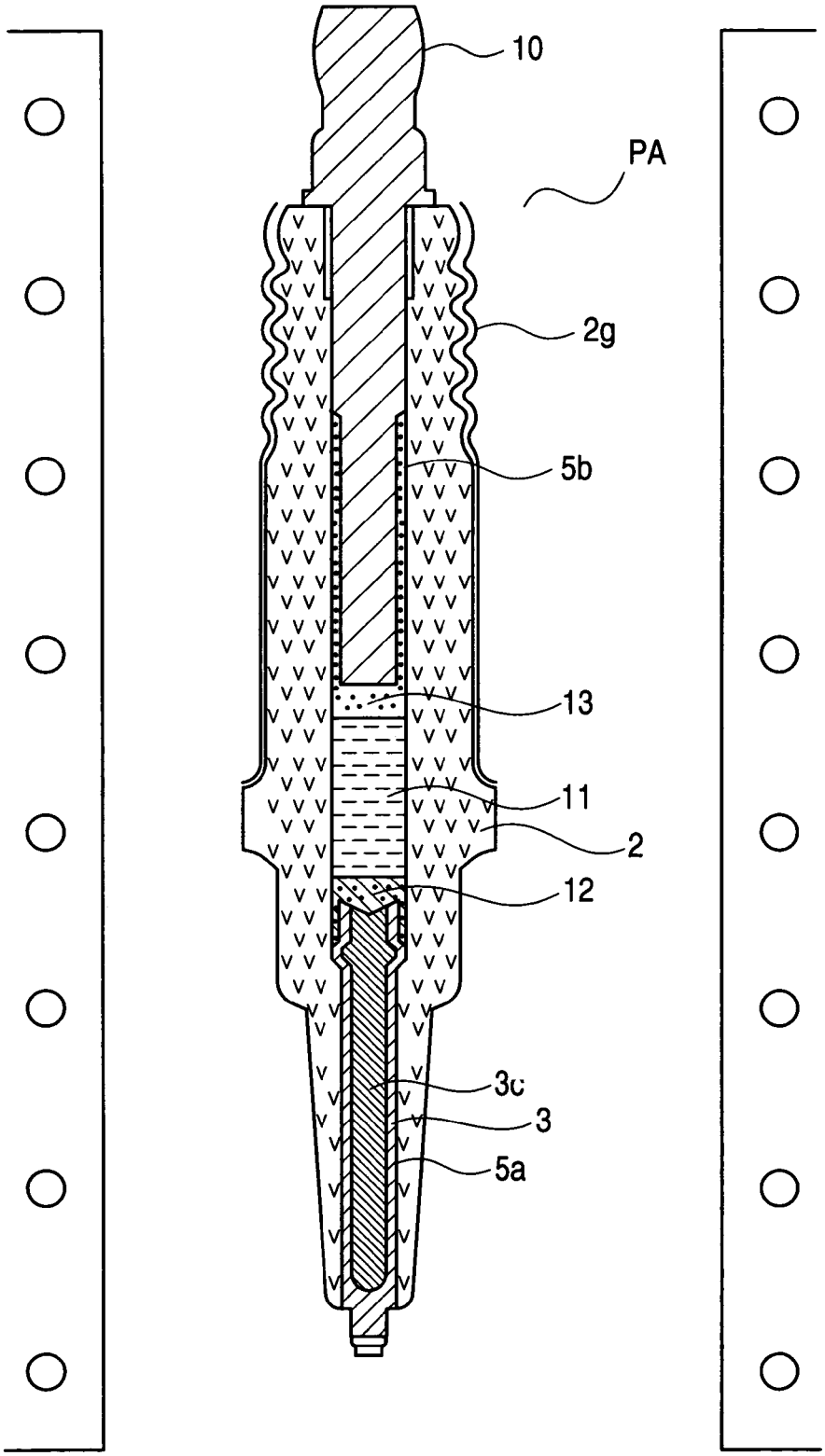
FIG. 7 is a sectional view showing an example of the spark plug manufacturing process of the invention.

As shown in FIG. 6, a plug assembly PA includes an external terminal 10 arranged in the through hole 5 at the rear end side. The plug assembly PA is heated to a predetermined temperature of 700 to 950° C. in a heating furnace. Then, the external terminal 10 is axially press-fitted into the through hole 5 toward the center electrode 3 to thereby press the individual layers 12*a*, 11*a* and 13*a* axially in a stacked state. As a result, the individual layers are compressed and sintered to become the conductive seal 12, the resistor 11 and the conductive seal 13, respectively, as shown in FIG. 7 (that is, the glass sealing process is completed). Simultaneously, the glaze-slurry layer 2*ga* is sintered to become the glaze layer 2*g*.

The metal shell 1, the ground electrode 4 and other components are assembled with the plug assembly PA thus having completed the glass sealing step, to thereby complete the spark plug 100, as shown in FIG. 1. This spark plug 100 is to be mounted at its threaded portion 1*a* in the engine block and is to be used as the ignition source for an air-fuel mixture to be fed to a combustion chamber.

A spark plug 200 according to a second embodiment is described as follows. Here, the spark plug 200 of the second embodiment is different from the spark plug 100 of the first embodiment only in the materials (composition) of the first conductive seal 12 and the second conductive seal 13. The spark plug 200 is described in detail with respect to these materials, and the description of the remaining portions is omitted.

In the spark plug 200 of the second embodiment, a first conductive seal 212 is made of base glass and a conductive filler. On the other hand, a second conductive seal 213 is made of base glass, a conductive filler and 1 weight % of insulating filler. The insulating filler is made of crystals of $TiO_2$.

Thus, the contents of the insulating filler in the first conductive seal 212 and the second conductive seal 213 are 20 weight % or less. This makes it possible to reduce the hardness of the first conductive seal 212 and the second conductive seal 213 at the base glass softening time. It is, therefore, possible to prevent terminal misalignment during the glass sealing process. Moreover, the sealing load during the glass sealing process need not be simply increased, so as to prevent the insulator 2 from being broken during the glass sealing process.

Moreover, the content of the insulating filler in the second conductive seal 213 is higher than that in the first conductive seal 212 so that the hardness of the second conductive seal 213 at the base glass softening point is higher than that of the first conductive seal 212 at the base glass softening point. Then, the resistor 11 interposed between the first conductive seal 212 and the second conductive seal 213 is sufficiently pushed by the second conductive seal 213 so that it can be properly filled and fixed inbetween.

EXAMPLES

The invention is described with reference to the following Examples. However, the present invention should not be construed as being limited thereto.

Example 1

At first, an insulator 2 was prepared in the following manner. A material powder or alumina powder (containing alumina in an amount of 95 mol % and Na (as converted to $Na_2O$) in an amount of 0.1 mol % and having an average particle diameter of 3.0 μm) was blended with $SiO_2$ (having a purity of 99.5% and an average particle diameter of 1.5 μm), $CaCO_3$ (having a purity of 99.9% and an average particle diameter of 2.0 μm), MgO (having a purity of 99.5% and an average particle diameter of 2 μm), $BaCO_3$ (having a purity of 99.5% and an average particle diameter of 1.5 μm) and $H_3BO_3$ (having a purity of 99.0% and an average particle diameter of 1.5 μm) at predetermined ratios. 3 parts by weight of PVA as a hydrophilic binder and 103 parts by weight of water were added to and wetly mixed with 100 parts by weight of the total of the blended powder, to thereby prepare a molding base slurry.

Next, these slurries of different compositions were dried by the spray drying method to prepare molding spherical base granules for molding. The granules were sifted to particle diameters of 50 to 100 μm. Then, the sifted granules were molded under a pressure of 40 MPa by the rubber press method described above. The outer face of the molding was worked by a grinder so that it was finished to a predetermined insulator shape. Then, the molding was sintered at 1,550° C. for 2 hours to thereby prepare the insulator 2. The insulator 2 thus prepared was found to have the following composition by fluorescent X-ray analysis:

Al Component: 94.9 mol %, as converted to $Al_2O_3$;
Si Component: 2.4 mol %, as converted to $SiO_2$;
Ca Component: 1.9 mol %, as converted to CaO;
Mg Component: 0.1 mol %, as converted to MgO;
Ba Component: 0.4 mol %, as converted to BaO; and
B Component: 0.3 mol %, as converted to $B_2O_3$.

Next, the metal powder containing the Cu powder and the Fe powder (both having an average particle diameter of 30 μm) blended at a mass ratio of 1:1, the insulating powder of $TiO_2$, and the base glass powder (having an average particle diameter of 150 μm) were mixed to have a metal powder content of about 50 weight % to thereby prepare the conductive sealer powder.

The composition of the base glass powder was 60 weight % of $SiO_2$, 32 weight % of $B_2O_3$, 0.5 weight % of CaO, 1 weight % of $Al_2O_3$, 3.5 weight % of $Na_2O$, 1 weight % of $K_2O$, 1 weight % of $ZrO_2$ weight % of MgO. Also, the insulating powder was prepared to have the contents indicated in Table 1.

Moreover, the resistor material powder was prepared in the following manner. At first, 30 weight % of fine glass powder (having an average particle diameter of 80 μm), 66 weight % of $ZrO_2$ (having an average particle diameter of 3 μm) as the ceramic powder, 1 weight % of carbon black, and 3 weight % of dextrin as an organic binder were blended and wetly mixed in a ball mill using water as a solvent. After this, the mixture was dried to obtain a preparatory material. Then, 80 parts by weight of coarse glass powder (having an average particle diameter of 250 μm) were blended with 20 parts by weight of the aforementioned preparatory material to thereby prepare the resistor material powder. Here, the material of the glass powder was the lithium borosilicate glass which had been obtained by blending and dissolving 50 weight % of $SiO_2$, 29 weight % of $B_2O_3$, 4 weight % of $Li_2O$ and 17 weight % of BaO and which had a softening temperature of 585° C.

Next, the conductive sealer powder and the resistor composite powder thus far described were used to make 100 spark plugs 100 having the resistor shown in FIG. 1, by the spark plug manufacturing process (FIG. 2 to FIG. 7) thus far described.

Moreover: the fill of the conductive sealer powder for forming the first conductive sealer powder layer 12*a* was 0.15 g; the fill of the resistor material powder for forming the resistor composite powder layer 11*a* was 0.40 g; and the fill of the conductive glass powder for forming the second conductive sealer powder layer 13*a* was 0.15 g. The hot press treatment was carried out a heating temperature of 900° C. and a pressure of 100 $Kg/cm^2$.

Moreover, the spark plug samples manufactured under the aforementioned conditions and spark plug Sample Nos. 1 to 7 (100 pieces each) manufactured by lowering the heating temperature of the hot press treatment by 50° C. were evaluated with respect to their respective sealing properties. The sealing evaluations were judged by visually observing the presence/absence of misalignment of the external terminal 10 from the insulator 2.

No misalignment of the external terminal 10 from the insulator 2 was observed in all spark plug samples which had been manufactured using a heating temperature of 900° C. for the hot press treatment. The results shown in Table 1 are for samples in which the heating temperature of the hot press treatment had been lowered by 50° C. (i.e., carried out at 850° C.). In Table 1: those sample types, all one hundred of which exhibited no misalignment of the external terminal 10 from the insulator 2, are indicated by "○"; those sample types, 1 of 100 of which exhibited misalignment of the external terminal 10, is indicated by "Δ"; and those sample types, 2 of 100 of which exhibited misalignment, are indicated by "X".

TABLE 1

| Sample No. | 1 | 2 | 3 | 4 | 5 | 6 | 7 |
|---|---|---|---|---|---|---|---|
| Content (in weight %) of the insulating filler in the first conductive seal 12 | 0 | 1 | 5 | 8 | 10 | 12 | 20 |
| Content (in weight %) of the insulating filler in the second conductive seal 13 | 0 | 1 | 5 | 8 | 10 | 12 | 20 |
| Sealing properties (hot press treatment at 850° C.) | ○ | ○ | ○ | ○ | ○ | Δ | X |

As seen from Table 1, those samples in which the contents of the insulating filler in the first conductive seal 12 and the second conductive seal 13 were 10 weight % or less, provided sufficient sealing properties.

Example 2

Next, spark plugs 100 of Example 1 were manufactured, having final base glass powder compositions for the first conductive seal 12 and the second conductive seal 13 as shown in Table 2. In Table 2, the compositions are indicated by weight %. In Table 2, Sample Nos. 8 to 11 had base glass compositions within the range of the invention, and Sample Nos. 12 to 22 had base glass compositions outside the range of the invention. Moreover, the content of the insulating filler was 0 weight %.

Figure 8:
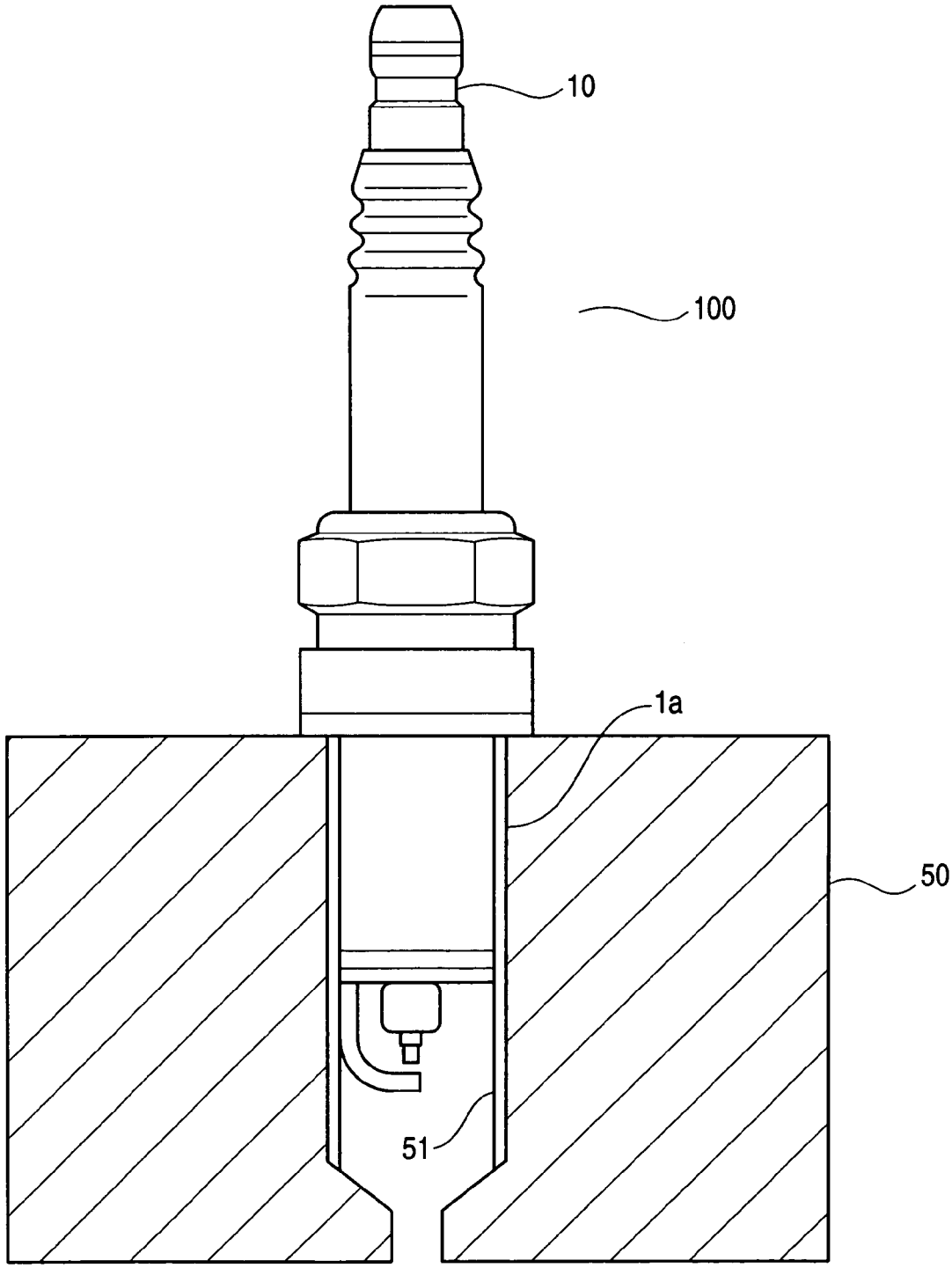
FIG. 8 is a schematic view showing a device for evaluating the sealing properties.

The spark plug samples (one hundred of each type were made) thus obtained were evaluated for airtightness. For these evaluations, the leakage of air from the side of the external terminal 10 was metered by fastening the threaded portion 1*a* of the spark plug sample in an internal thread 51 of a pressure cavity formed in a pressure tester 50, as shown in FIG. 8, and by introducing compressed air at two different pressure levels of 1.5 MPa (for standard tests) and 2.5 MPa (for acceleration tests) into the pressure cavity.

When compressed air was introduced into the pressure cavity at a pressure of 1.5 MPa (for the standard tests), no air leakage was observed for all spark plug samples. For acceleration tests in which compressed air was introduced into the pressure cavity at a pressure of 2.5 MPa, the results are given in Table 2. In Table 2: those samples exhibiting no leakage, are indicated by "○"; those samples exhibiting an average leakage of 0.05 ml/min. or less, are indicated by "Δ"; and those samples exhibiting an average leakage of 0.05 ml/min. or more, are designated as leaking samples "X".

Moreover, sealing evaluations like those of Example 1 were individually made on the spark plug samples manufactured as in Example 1, and on the spark plug samples manufactured by lowering the heating temperature for the hot press treatment by 50° C. No misalignment of the external terminal 10 from the insulator 2 was observed on all spark plug samples manufactured at a hot press treatment heating temperature of 900° C. The results shown in Table 2 are for samples in which the heating temperature of the hot press treatment had been lowered by 50° C. (i.e., where the hot press treatment carried out was at 850° C.)

TABLE 2

| Sample No. | 8 | 9 | 10 | 11 | 12 | 13 | 14 | 15 | 16 | 17 | 18 | 19 | 20 | 21 | 22 |
|---|---|---|---|---|---|---|---|---|---|---|---|---|---|---|---|
| $SiO_2$ | 60.0 | 63.0 | 56.0 | 60.0 | 68.0 | 53.0 | 65.0 | 57.5 | 62.0 | 60.0 | 60.0 | 62.0 | 58.0 | 60.0 | 60.0 |
| $B_2O_3$ | 32.0 | 27.0 | 33.0 | 32.0 | 25.0 | 35.0 | 20.0 | 37.0 | 30.0 | 29.0 | 29.0 | 31.0 | 29.5 | 32.0 | 32.0 |
| CaO | 0.5 | 1.0 | 1.5 | 0.5 | 1.0 | 1.5 | 2.0 | 0.5 | 0.0 | 3.0 | 1.0 | 0.5 | 0.5 | 0.5 | 0.5 |
| $Al_2O_3$ | 1.0 | 0.5 | 0.5 | 1.0 | 1.0 | 1.0 | 1.0 | 0.5 | 0.5 | 0.0 | 3.0 | 1.0 | 0.0 | 1.0 | 1.0 |
| $Na_2O$ | 3.5 | 5.0 | 3.5 | 1.0 | 4.0 | 4.5 | 5.0 | 4.0 | 3.5 | 4.0 | 4.0 | 3.0 | 6.0 | 0.0 | 4.5 |
| $K_2O$ | 1.0 | 1.5 | 3.5 | 3.5 | 1.0 | 2.0 | 3.0 | 0.5 | 1.5 | 2.0 | 2.0 | 0.5 | 3.0 | 4.5 | 0.0 |
| $ZrO_2$ | 1.0 | 1.0 | 1.0 | 1.0 | 0.0 | 1.0 | 1.0 | 0.0 | 1.0 | 1.0 | 1.0 | 1.0 | 1.0 | 1.0 | 1.0 |
| $TiO_2$ | 0.0 | 1.0 | 1.0 | 0.0 | 0.0 | 1.0 | 1.0 | 0.0 | 1.0 | 0.0 | 0.0 | 1.0 | 1.0 | 0.0 | 0.0 |
| MgO | 1.0 | 0.0 | 0.0 | 1.0 | 0.0 | 1.0 | 2.0 | 0.0 | 1.0 | 1.0 | 0.0 | 0.0 | 1.0 | 1.0 | 1.0 |
| W1 + W2 | 4.5 | 6.5 | 7.0 | 4.5 | 5.0 | 6.5 | 8.0 | 4.5 | 4.5 | 6.0 | 6.0 | 3.5 | 9.0 | 4.5 | 4.5 |
| W1 ≧ W2 | ○ | ○ | ○ | X | ○ | ○ | ○ | ○ | ○ | ○ | ○ | ○ | ○ | X | ○ |
| Airtightness (2.5 MPa) | ○ | ○ | ○ | Δ | ○ | X | ○ | X | Δ | X | Δ | Δ | X | Δ | Δ |
| Sealing Properties (hot press treatment at 850° C.) | ○ | ○ | ○ | ○ | X | ○ | X | ○ | X | ○ | X | X | ○ | X | X |

As seen from Table 2, all samples having a base glass composition of the conductive sealer within the range of the invention provided sufficient airtightness and sealing properties. Furthermore, all samples in which the relationship W1≧W2 was satisfied (where the weight of the Na component, as converted to $Na_2O$, is indicated by W1 and the weight of the K component, as converted to $K_2O$, was indicated by W2), exhibited excellent airtightness and sealing properties.

Example 3

Next, spark plugs 200 were manufactured similar to the spark plugs 100 of Examples 1 and 2. Here, the base glass of Example 1 was used as the base glass for the first conductive seal 212 and the second conductive seal 213. The composition of the second conductive seal 213 was adjusted to have an insulating filler content of that of Sample Nos. 23 to 27, as shown in Table 3. In Example 3, the first conductive seal 212 did not contain an insulating filler (i.e., content of 0 weight %).

Sample Nos. 23 to 27 were subjected to an inserted resistor load lifetime test as specified in JIS B8031-1995. Samples found to have a change in resistance before and after the test larger than ±20% and smaller than ±30% are indicated by "O", and samples found to have a change in resistance before and after the test smaller than ±20% are indicated by "OO". The results are shown in Table 3.

TABLE 3

| Sample No. | 23 | 24 | 25 | 26 | 27 |
|---|---|---|---|---|---|
| Content (in weight %) of the insulating filler in the second conductive seal 213 | 0 | 1 | 5 | 8 | 10 |
| Load Lifetime Characteristics | ○ | ○○ | ○○ | ○○ | ○○ |

As shown by Example 3, the load lifetime characteristics can be especially effectively improved by adjusting the content of insulating filler in the second conductive seal 212 so that it is higher than the content of insulating filler in the first conductive seal 213.

This application is based on Japanese Patent application JP 2004-136186, filed Apr. 30, 2004, the entire content of which is hereby incorporated by reference, the same as if set forth at length.

What is claimed is:

1. A spark plug comprising:

an insulator having a through hole in an axial direction of said spark plug and comprising alumina ceramics;

a center electrode partially inserted in a front end of the through hole;

an external terminal partially inserted in a rear end of the through hole; and a conductive seal provided between said external terminal and said center electrode in said through hole, wherein said conductive seal contains base glass, a conductive filler and from 0 to 10 weight % of an insulating filler, said base glass contains:

a Si component in an amount of from 55 to 65 weight %, in terms of $SiO_2$, a B component in an amount of from 22 to 35 weight %, in terms of $B_2O_3$, a Ca component in an amount of from 0.2 to 2 weight %, in terms of CaO, an Al component in an amount of 2 weight % or less, in terms of $Al_2O_3$, and a Na component and a K component in a total amount of from 4 to 8 weight %, in terms of $Na_2O$ and $K_2O$, respectively, and said base glass contains both said Na component and said K component.

2. The spark plug as claimed in claim 1, wherein a weight of said Na component contained in said base glass, in terms of $Na_2O$, is no less than a weight of said K component contained in said base glass, in terms of $K_2O$.

3. The spark plug as claimed in claim 1, wherein said conductive seal does not contain an insulating filler.

4. The spark plug as claimed in claim 1, wherein a total of a weight of said Si component, in terms of $SiO_2$, and a weight of said B component, in terms of $B_2O_3$, is from 86 to 94 weight %, based on a weight of said base glass.

5. A spark plug comprising:

an insulator having a through hole in an axial direction of said spark plug;

a first conductive seal provided in said through hole;

a second conductive seal provided in said through hole;

a center electrode partially inserted in a front end of said through hole and bonded to said first conductive seal;

an external terminal partially inserted in a rear end of said through hole and bonded to said second conductive seal; and a resistor provided between said first conductive seal and said second conductive seal, wherein said second conductive seal contains base glass, a conductive filler, and 10 weight % or less, but more than 0 weight % of an insulating filler, and said first conductive seal contains base glass, a conductive filler, and an insulating filler in an amount (including 0 weight %) smaller than that of said insulating filler contained in said second conductive seal.

6. The spark plug as claimed in claim 5, wherein said first conductive seal does not contain an insulating filler.

7. The spark plug as claimed in claim 5, wherein said insulator comprises alumina ceramics, the base glasses of said first and second conductive seal each independently contains:

a Si component in an amount of from 55 to 65 weight %, in terms of $SiO_2$;

a B component in an amount of from 22 to 35 weight %, in terms of $B_2O_3$;

a Ca component in an amount of from 0.2 to 2 weight %, in terms of CaO;

an Al component in an amount of 2 weight % or less, in terms of $Al_2O_3$; and a Na component and a K component in a total amount of from 4 to 8 weight %, in terms of $Na_2O$ and $K_2O$, respectively, and said base glasses each independently contains both said Na component and said K component.

8. The spark plug as claimed in claim 7, wherein in both of said first and second conductive seals, a weight of said Na component contained in said base glass, in terms of $Na_2O$, is no less than a weight of said K component contained in said base glass, in terms of $K_2O$.

9. The spark plug as claimed in claim 7, wherein in both of said first and second conductive seals, a total weight of said Si component, in terms of $SiO_2$, and said B component, in terms of $B_2O_3$, is from 86 to 94 weight %, based on a weight of said base glass.

10. The spark plug as claimed in claim 1, wherein the relationship $W1 \geqq W2 \geqq W1/5$ is satisfied, wherein the weight of the Na component in the base glass, as converted to $Na_2O$, is given by W1 and the weight of the K component, as converted to $K_2O$, is given by W2.

* * * * *